US011846049B2

(12) United States Patent
Ogale et al.

(10) Patent No.: US 11,846,049 B2
(45) Date of Patent: Dec. 19, 2023

(54) BRAIDING APPARATUS FOR BRAIDING BROAD TAPE

(71) Applicant: The Boeing Company, Chicago, IL (US)

(72) Inventors: Amol Ogale, Munich (GE); Randall Wilkerson, O'Fallown, MO (US); Franz Jürgen Kumpers, Rheine (GE); Gregor Baumgart, Viersen (GE); Ayham Younes, Koln (GE)

(73) Assignee: The Boeing Company, Arlington, VA (US)

( * ) Notice: Subject to any disclaimer, the term of this patent is extended or adjusted under 35 U.S.C. 154(b) by 22 days.

(21) Appl. No.: 17/674,334

(22) Filed: Feb. 17, 2022

(65) Prior Publication Data

US 2022/0341092 A1 Oct. 27, 2022

Related U.S. Application Data

(60) Provisional application No. 63/178,868, filed on Apr. 23, 2021.

(51) Int. Cl.

| | |
|---|---|
| ***D04C 3/16*** | (2006.01) |
| ***D04C 3/40*** | (2006.01) |
| ***D07B 3/04*** | (2006.01) |

(52) U.S. Cl.

CPC ..... *D04C 3/16* (2013.01); *D04C 3/40* (2013.01); *D07B 3/04* (2013.01); *D07B 2201/1096* (2013.01); *D07B 2207/209* (2013.01)

(58) Field of Classification Search

CPC ... D04C 3/14; D04C 3/16; D04C 3/18; D04C 3/40

See application file for complete search history.

(56) References Cited

U.S. PATENT DOCUMENTS

| | | | | | |
|---|---|---|---|---|---|
| 1,172,719 | A | * | 2/1916 | Littlefield | D04C 3/14 87/22 |
| 2,058,918 | A | * | 10/1936 | Scott | D04C 3/14 87/22 |
| 2,459,617 | A | * | 1/1949 | Carter | D04C 3/14 242/419.1 |

(Continued)

FOREIGN PATENT DOCUMENTS

EP 3018245 B1 12/2016

*Primary Examiner* — Shaun R Hurley

(74) *Attorney, Agent, or Firm* — McDonnell Boehnen Hulbert & Berghoff LLP

(57) ABSTRACT

A braiding apparatus for forming braided tubing comprises a braiding wheel and a plurality of bobbins. The plurality of bobbins are configured to move circumferentially around the braiding wheel. Each bobbin includes a spool, a first pulley assembly, and a second pulley assembly. The spool is configured to hold a tow formed from a braiding material. The first pulley assembly is coupled to the spool at a first distance from the spool. The first pulley assembly is configured to facilitate passing the tow over a pulley of the first pulley assembly. The second pulley assembly is coupled to the spool at a second distance that is less than the first distance. The second pulley assembly is configured to facilitate receiving the tow from the first pulley assembly and passing the tow over a pulley of the second pulley assembly and towards a section of the braiding apparatus at which a plurality of tows come together to form the braided tubing.

20 Claims, 10 Drawing Sheets

(56) References Cited

U.S. PATENT DOCUMENTS

| | | | | | |
|---|---|---|---|---|---|
| 2,897,715 | A * | 8/1959 | Olson | D04C 3/14 | 87/56 |
| 4,788,898 | A * | 12/1988 | Bull | D04C 3/18 | 87/22 |
| 4,803,909 | A * | 2/1989 | Smith | D04C 3/22 | 87/8 |
| 4,881,444 | A * | 11/1989 | Krauland | D04C 3/34 | 87/8 |
| 4,972,756 | A * | 11/1990 | Du | D04C 3/14 | 87/61 |
| 5,186,092 | A * | 2/1993 | DeYoung | D04C 3/18 | 87/22 |
| 5,476,027 | A * | 12/1995 | Uchida | D04C 3/48 | 87/29 |
| 7,464,633 | B1 * | 12/2008 | Kao | D04C 3/16 | 87/55 |
| 9,200,388 | B1 * | 12/2015 | Gallmeyer | B65H 54/02 | |
| 2004/0254633 | A1 * | 12/2004 | Rapaport | D04C 3/18 | 623/1.15 |
| 2005/0150370 | A1 * | 7/2005 | Nishri | D04C 1/02 | 87/33 |
| 2012/0144984 | A1 * | 6/2012 | Head, III | D04C 3/18 | 87/8 |
| 2014/0044965 | A1 * | 2/2014 | Linow | F16L 9/128 | 156/380.9 |
| 2016/0121936 | A1 * | 5/2016 | Patberg | B60R 13/0815 | 296/191 |
| 2016/0251786 | A1 * | 9/2016 | Ichikawa | D04C 3/18 | 87/55 |
| 2018/0127088 | A1 * | 5/2018 | Amat | B32B 5/18 | |

* cited by examiner

BRAIDING APPARATUS FOR BRAIDING BROAD TAPE

RELATED APPLICATIONS

This application claims the benefit of priority under 35 U.S.C. § 119(e) of U.S. Provisional Application No. 63/178,868, filed Apr. 23, 2021, the content of which is incorporated herein by reference in its entirety.

BACKGROUND

Field

This application generally relates to processes for interlacing braiding materials together to form a braided product such as braided tubing. In particular, this application describes a braiding apparatus for braiding broad tape.

Description of Related Art

A braiding machine is a device that interlaces or weaves together several strands (e.g., three or more strands) of a braiding material such as yarn, wire, tape, etc. to create a braided product such as rope, a reinforced hose, a covering for electrical wiring, etc. A typical braiding machine includes a wheel configured to direct strands from several regions around the wheel towards a center region of the wheel to form the braided product. Rotation of the wheel weaves/interlaces these strands together.

Most braiding material has a relatively small cross-section. For example, the width of a tape-like braiding material is typically less than or equal to ¼ inch. The relatively small width limits the size of braided tubing formed from such material to, for example, less than five inches in diameter. Braiding tape-like materials having relatively large widths (e.g., greater than ¼ inch) presents many challenges in part because the larger material tends to be more rigid and, therefore, more difficult to weave.

SUMMARY

In a first aspect, a braiding apparatus for forming braided tubing comprises a braiding wheel and a plurality of bobbins. The bobbins are configured to move circumferentially around the braiding wheel. Each bobbin includes a spool, a first pulley assembly, and a second pulley assembly. The spool is configured to hold a tow formed from a braiding material. The first pulley assembly is coupled to the spool at a first distance from the spool. The first pulley assembly is configured to facilitate passing the tow over a pulley of the first pulley assembly. The second pulley assembly is coupled to the spool at a second distance that is less than the first distance. The second pulley assembly is configured to facilitate receiving the tow from the first pulley assembly and passing the tow over a pulley of the second pulley assembly and towards a section of the braiding apparatus at which a plurality of tows come together to form the braided tubing.

In a second aspect, a bobbin for a braiding tool comprises a spool, a first pulley assembly, and a second pulley assembly. The spool is configured to hold a tow formed from a braiding material. The first pulley assembly is coupled to the spool at a first distance from the spool. The first pulley assembly is configured to facilitate passing the tow over a pulley of the first pulley assembly. The second pulley assembly is coupled to the spool at a second distance that is less than the first distance. The second pulley assembly is configured to facilitate receiving the tow from the first pulley assembly and passing the tow over a pulley of the second pulley assembly and towards a section of a braiding apparatus at which a plurality of tows come together to form braided tubing.

In a third aspect, a method of manufacturing braided tubing comprises arranging a plurality of bobbins circumferentially around a braiding wheel of a braiding apparatus. Each bobbin includes a spool, a first pulley assembly, and a second pulley assembly. The spool is configured to hold a tow formed from a braiding material. The first pulley assembly is coupled to the spool at a first distance from the spool. The second pulley assembly is coupled to the spool at a second distance that is less than the first distance. The method further comprises threading a tow held on the spool over a pulley of the first pulley assembly and then over a pulley of the second pulley assembly and then towards a section of the braiding apparatus at which a plurality of tows come together to form the braided tubing. The plurality of bobbins are moved around the braiding wheel to thereby form the braided tubing.

BRIEF DESCRIPTION OF THE DRAWINGS

The accompanying drawings are included to provide a further understanding of the claims, are incorporated in, and constitute a part of this specification. The detailed description and illustrated examples described serve to explain the principles defined by the claims.

DETAILED DESCRIPTION

Figure 1:
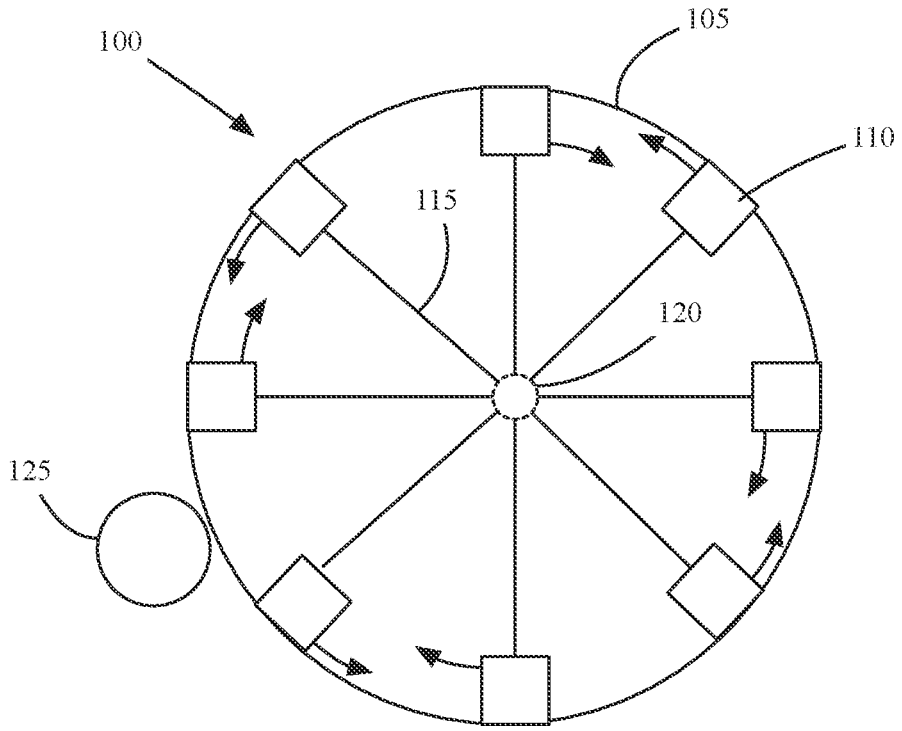
FIG. 1 illustrates a braiding apparatus, in accordance with an example.

Various examples of systems, devices, and/or methods are described herein. Words such as "example" and "exemplary" that may be used herein are understood to mean "serving as an example, instance, or illustration." Any embodiment, implementation, and/or feature described herein as being an "example" or "exemplary" is not necessarily to be construed as preferred or advantageous over any other embodiment, implementation, and/or feature unless stated as such. Thus, other embodiments, implementations, and/or features may be utilized, and other changes may be made without departing from the scope of the subject matter presented herein.

Accordingly, the examples described herein are not meant to be limiting. It will be readily understood that the aspects of the present disclosure, as generally described herein, and illustrated in the figures, can be arranged, substituted, combined, separated, and designed in a wide variety of different configurations.

Further, unless the context suggests otherwise, the features illustrated in each of the figures may be used in combination with one another. Thus, the figures should be generally viewed as component aspects of one or more overall embodiments, with the understanding that not all illustrated features are necessary for each embodiment.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Moreover, terms such as "substantially" or "about" that may be used herein, mean that the recited characteristic, parameter, or value need not be achieved exactly, but that deviations or variations, including, for example, tolerances, measurement error, measurement accuracy limitations and other factors known to one skilled in the art, may occur in amounts that do not preclude the effect the characteristic was intended to provide.

I. Introduction

As noted above, braiding tape-like materials having relatively large widths (e.g., greater than ¼ inch) presents many challenges because the larger material tends to be more rigid and, therefore, difficult to weave. This, in turn, limits the size of most braided tubing or product formed from tape-like materials to relatively small diameters such as, for example, less than five inches.

Disclosed herein are examples of a braiding apparatus that facilities the manufacture of braided tubing or product having relatively large diameters, such as braided tubing having a diameter up to and greater than ten inches. Generally, the braiding apparatus includes a braiding wheel, and a plurality of bobbins arranged circumferentially around the braiding wheel. As will be described in further detail below, each bobbin includes a spool, a first pulley assembly, and a second pulley assembly. The spool is configured to hold a tow formed from a braiding material. As used herein, the term "tow" corresponds to the strand or strands that are weaved together to form the braided material.

The first pulley assembly is coupled to the spool at a first distance from the spool. The first pulley assembly is configured to facilitate passing the tow over a pulley of the first pulley assembly. The second pulley assembly is coupled to the spool at a second distance that is less than the first distance. The second pulley assembly is configured to facilitate receiving the tow from the first pulley assembly and passing the tow over a pulley of the second pulley assembly and towards a section of the braiding apparatus at which a plurality of tows come together to form the braided tubing.

In some examples, each bobbin comprises one or more rods coupled at a first end to the spool. The rods couple the first pulley assembly and the second pulley assembly to the spool. In an example, the first pulley assembly is fixed at second ends of the rods, and the second pulley assembly is slidably coupled to the rods. In some examples, a resilient member is arranged on at least one of the rods between the first pulley assembly and the second pulley assembly. The resilient member facilitates controlling an amount of tension on the tow.

In some examples, each bobbin includes a brake. The brake is coupled to the spool and, when engaged, is configured to prevent or slow rotation of the spool. In examples, each bobbin includes a switch configured to actuate when a distance between the first pulley assembly and the second pulley assembly exceeds a predetermined distance. The actuation of the switch causes the brake to engage.

In some examples, each bobbin includes a mount configured to couple the bobbin to the braiding wheel. In some examples, every other bobbin arranged circumferentially around the braiding wheel further includes an elongated member that couples the spool to the mount. The elongated member facilitates decreasing the spacing between adjacent bobbins and, therefore, facilitates increasing the number of tows weaved together for a braiding wheel having a particular diameter.

FIG. 1 illustrates an example of a braiding apparatus 100. As shown, the braiding apparatus 100 includes a braiding wheel 105, and a plurality of bobbins 110 configured to move circumferentially around the braiding wheel 105. In an example, the braiding wheel 105 has a circular shape. An example of the braiding wheel 105 has a diameter of 80 inches or greater. An example of the braiding wheel 105 includes a track assembly arranged around the periphery that facilitates moving a first set of bobbins 110 in a clockwise direction and a second set of bobbins 110 in an anti-clockwise direction to interleave the movement of the bobbins 110. An example of the braiding wheel 105 is mechanically coupled to a motor 125, and the motor is configured to move the bobbins 110 within the track assembly of the braiding wheel 105.

Examples of the bobbins 110 are uniformly distributed around the periphery of the braiding wheel 105. As noted above, each bobbin 110 is configured to release a tow 115. The tows 115 are weaved together in a center region in front of the braiding apparatus 100 to form braided tubing 120 by rotating the braiding wheel 105.

Figure 2A:
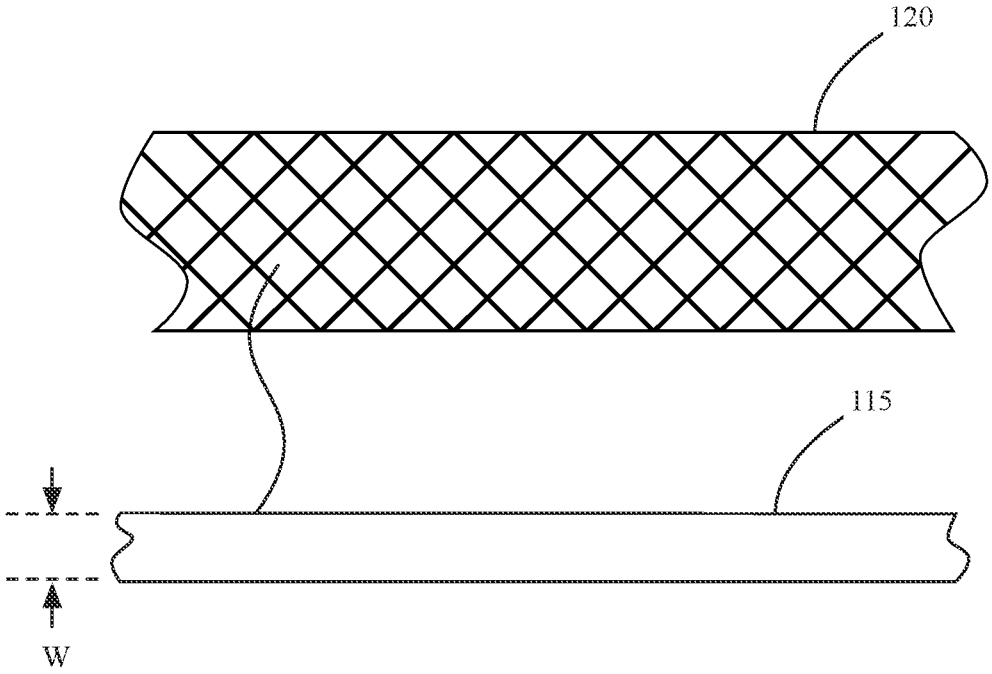
FIG. 2A illustrates braided tubing formed by the braiding apparatus, in accordance with an example.
Figure 2B:
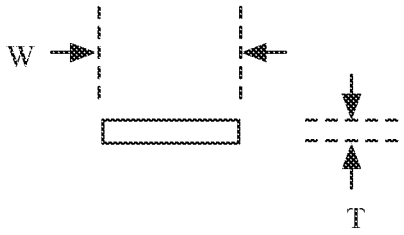
FIG. 2B illustrates a profile of a tow of the braided tubing, in accordance with an example.

FIGS. 2A and 2B illustrate aspects associated with the braided tubing 120. Referring to the figures, in an example, the tows 115 of the braided tubing 120 correspond to a flat/tape-like material. An example of the tow 115 is formed from a prepreg thermoplastic tape. An example of the tow 115 has a width, W, of ½ inch or greater and a thickness, T, of about 0.005 inches. In an example, 46 tows 115 having a width of a ½ inch are weaved together at a pitch or angle of 45 degrees to form braided tubing 120 having a diameter of 10 inches.

In some cases, the tows 115 are formed from segments that are spliced together. For instance, in an example where the tows 115 are from a prepreg material, the tows 115 are spliced together by welding or melting the ends of the segments. This facilitates forming tows 115 having arbitrarily long lengths, which, in turn, facilitates forming braided tubing 120 having arbitrability long lengths. For instance, an example of braided tubing 120 formed via the operations disclosed herein is longer than 10 feet.

Figure 3:
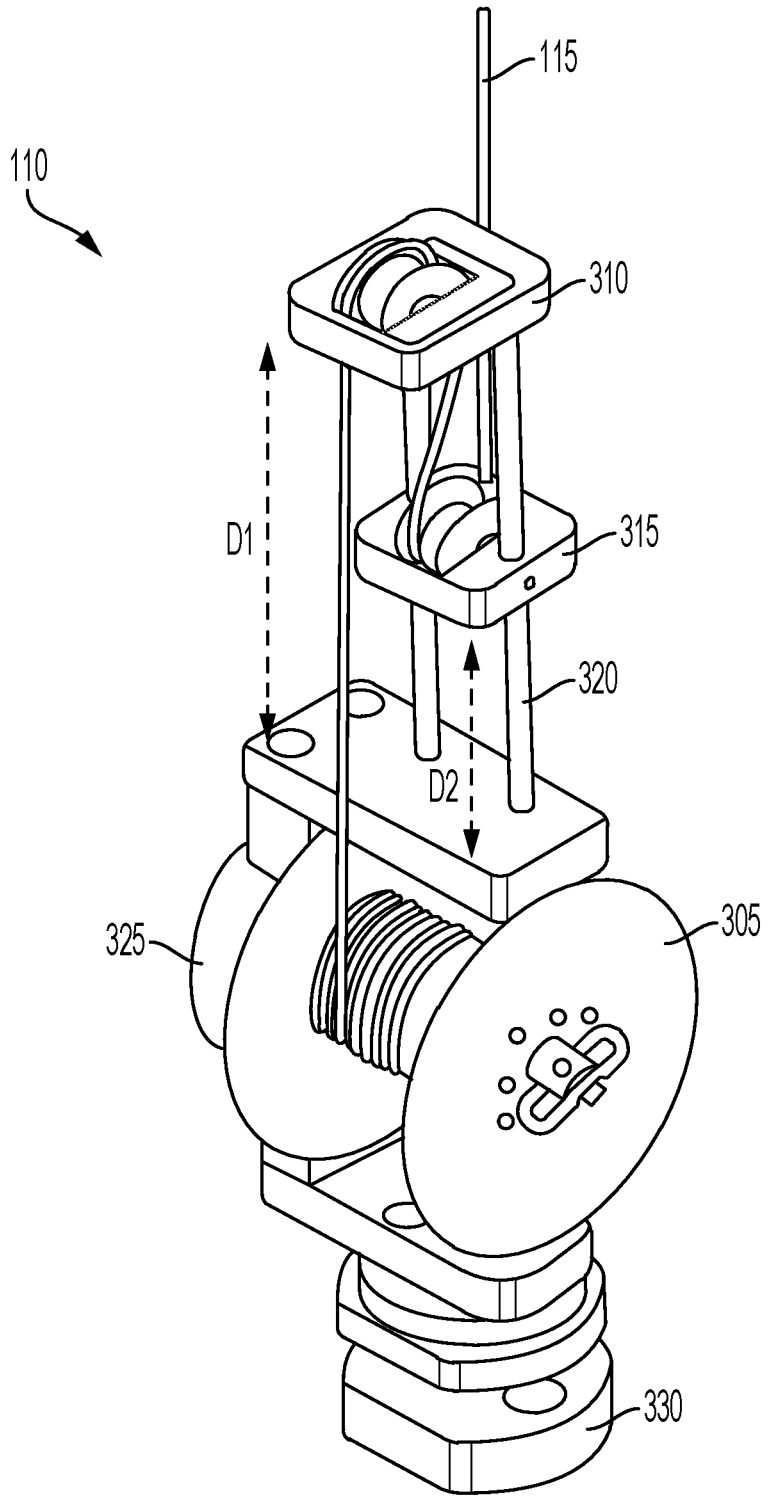
FIG. 3 illustrates a bobbin of the braiding apparatus, in accordance with an example.

FIG. 3 illustrates an example of a bobbin 110. Referring to the figure, the bobbin 110 includes a spool 305, a first pulley assembly 310, and a second pulley assembly 315.

Some examples of the bobbin 110 include a mount 330 that facilitates mounting the bobbin 110 to a mounting region of the braiding wheel 105.

An example of the spool 305 is configured to hold a tow 115 formed from a braiding material. For instance, an example of the spool 305 includes a cylindrical region around which the tow 115 is wrapped. An example of the cylindrical region has a diameter of 1 inch and a length of 3 inches. An example of the spool 305 includes sidewalls that facilitate wrapping 150 feet of tow 115 on the spool 305. An example of the spool 305 is configured to rotate around a shaft of the bobbin 110 to release the tow 115. As described in more detail below, in some examples, rotation of the spool 305 is stopped or slowed by the application of a brake that applies a braking force to the spool 305.

An example of the first pulley assembly 310 is coupled to the spool 305 at a first distance, D1, from the spool 305. In an example, the first distance, D1, is between 5 and 15 inches. The first pulley assembly 310 is configured to facilitate passing the tow 115 over a pulley of the first pulley assembly 310. For instance, in an example, the tow 115 is pulled up from the spool 305 and over the pulley.

An example of the second pulley assembly 315 is coupled to the spool 305 at a second distance, D2, that is less than the first distance, D1. In an example, the second distance, D2, is between 2 and 5 inches. The second pulley assembly 315 is configured to facilitate receiving the tow 115 from the first pulley assembly 310 and passing the tow 115 over a pulley of the second pulley assembly 315 and towards a section of the braiding apparatus 100 at which a plurality of tows 115 come together to form the braided tubing 120.

FIGS. 4A-4D illustrate examples of the first pulley assembly 310 and the second pulley assembly 315. As illustrated, an example of the first pulley assembly 310 and the second pulley assembly 315 include a frame 405 and a pulley 410.

An example of the frame 405 is formed from a rigid material such as a metal or metal alloy. Other examples of the frame 405 are formed from rigid thermoplastic materials. An example of the frame 405 has a square or rectangular shape. An example of the frame 405 defines an opening in a central region that is sized to accommodate a pulley 410.

An example of the pulley 410 is configured to accommodate the tow 115 described above. For instance, an example of the pulley 410 has a center section having a width that is a margin wider than the width, W, of the tow 115. An example of the pulley 410 includes sidewalls that are a margin taller than the thickness, T, of the tow 115. In an example, the profile of the center section is configured to match the profile of the tow 115. For instance, an example of the profile is flat to match the flat profile of the tow 115 described above. Another example the profile is curved to match a tow 115 having a curved/circular profile. In an example, the pulley 410 is rotatably coupled to the frame 405 via a shaft.

As noted above, an example of the bobbin 110 includes at least one rod 320 and, in some examples, a pair of rods 320. Examples of the rods 320 are coupled at a first end to the spool 305. The rods 320 are also coupled to the first pulley assembly 310 and the second pulley assembly 315 to thereby couple the first pulley assembly 310 and the second pulley assembly 315 to the spool 305. For instance, an example of the frame 405 of the first pulley assembly 310 and the frame 405 of the second pulley assembly 315 include one or more rod channels 415 through which the rods 320 are configured to pass or engage. An example of a rod channel 415 corresponds to a cylindrical cutout having a diameter configured to match or be a margin larger than a diameter of a rod 320.

Figure 4A:
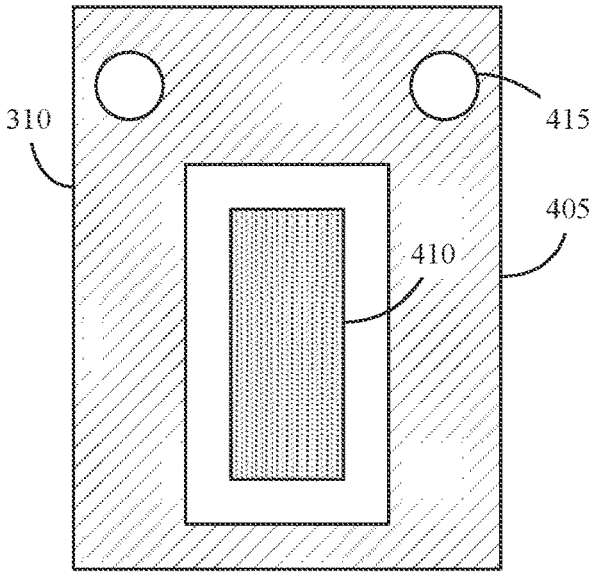
FIG. 4A illustrates a first pulley assembly of the bobbin, in accordance with an example.
Figure 4B:
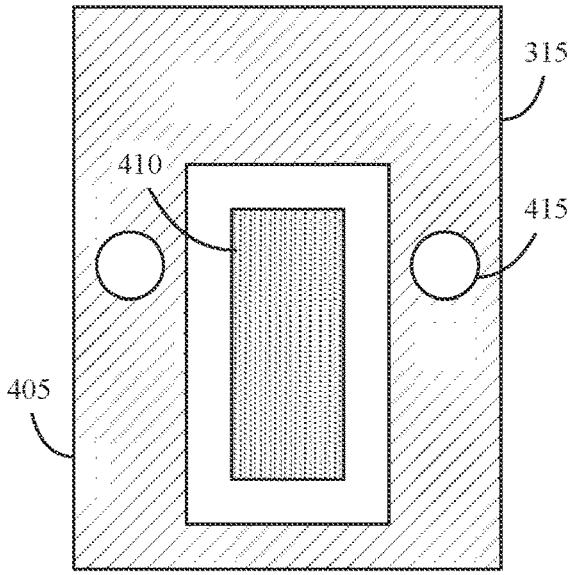
FIG. 4B illustrates a second pulley assembly of the bobbin, in accordance with an example.
Figure 4C:
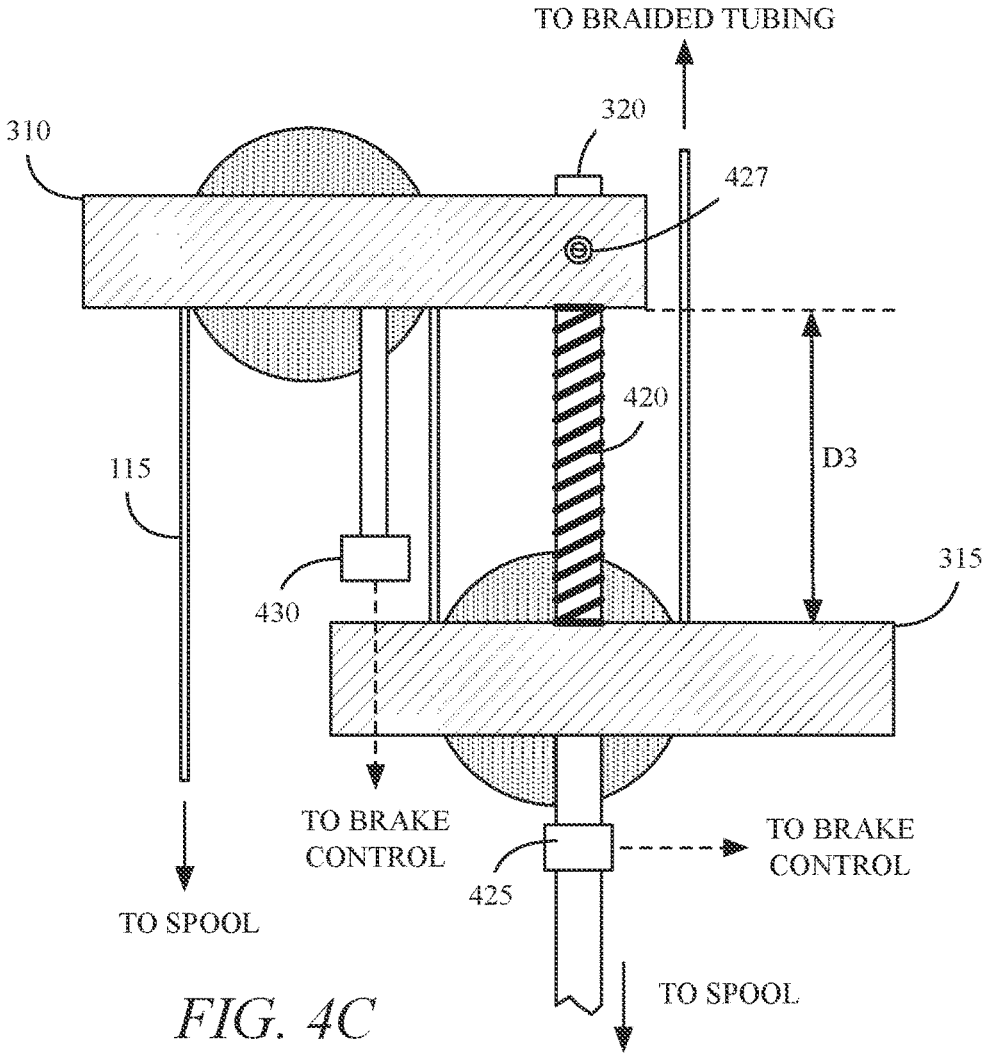
FIG. 4C illustrates the first pulley assembly and the second pulley assembly coupled to a rod of the bobbin, in accordance with an example.

In an example, the rod channels 415 of the first pulley assembly 310 are positioned towards an end of the frame 405 of the first pulley assembly 310, and the rod channels 415 of the second pulley assembly 315 are positioned towards a middle region of the frame 405 of the second pulley assembly 315. This positioning of the rod channels 415 facilitates offsetting the first pulley assembly 310 from the second pulley assembly 315, and wrapping the tow 115 around the pulley 410 of the first pulley assembly 310 and the pulley 410 of the first pulley assembly 315, as shown in FIG. 4C.

In an example, the first pulley assembly 310 is fixed to the ends of the rods 320, and the second pulley assembly 315 is slidably coupled to the rods 320. For instance, an example of the frame 405 of the first pulley assembly 310 includes threaded channels 427 that extend perpendicularly towards the rod channels 415, and that are configured to receive threaded fasteners configured to fix the rods 320 within the rod channels 415. The fasteners are screwed into the threaded channels 427 and press against the side of the rods 320 to fix the frame 405 to the rods 320. In another example, the ends of the rods 320 are threaded, and the rod channels 415 of the first pulley assembly 310 are threaded to facilitate screwing the ends of the rods 320 into the rod channels 415.

In an example, the frame 405 of the second pulley assembly 315 is configured to freely move or slide along the rods 320. In this regard, examples of the rod channels 415 of the second frame assembly 315 include a bearing surface that facilitates smooth movement of the second pulley assembly 315 longitudinally along the rods 320. In an example, the bearing surface corresponds to a relatively "soft" metal material such as brass. In some examples, ball bearings or different types of bearings are used to facilitate longitudinally sliding the second pulley assembly 315 along the rods 320.

As noted above, an example of the bobbin 110 includes one or more resilient members 420. Examples of the resilient members 420 are positioned between the first pulley assembly 310 and the second pulley assembly 315. The resilient members 420 are configured to urge the second pulley assembly 315 away from the first pulley assembly 310. In doing so, the resilient members 420 facilitate controlling an amount of tension on the tow 115. For example, when tension on the tow 115 momentarily decreases, the resilient force of the resilient members 420 against the second pulley assembly 315 causes the second pulley assembly 315 to move away from the first pulley assembly 310, taking up any slack in the tow 115 that may result from the momentary decrease in tension. Conversely, when tension on the tow 115 momentarily increases, the second pulley assembly 315 is allowed to move towards the first pulley assembly 310 to lower tension in the tow 115.

An example of a resilient member 420 corresponds to a helical coil and is coiled around the rod 320 in a position of the rod 320 between the first pulley assembly 310 and the second pulley assembly 315. Another example of a resilient member 420 is positioned between the spool 305 and the second assembly 315 and is configured to urge the second assembly 315 towards the spool 305.

As noted above, an example of the bobbin 110 includes a brake 325 that is coupled to the spool 305. When engaged, the brake 325 slows or stops rotation of the spool 305. An example of the brake 325 is configured to apply a force against the spool 305 that slows or stops the spool 305 from rotating. An example of the brake 325 slows or stops the spool 305 via magnetic induction. For instance, in an example, the brake 325 includes electromagnetic coils that, when energized, induce an electromotive force against a ferrous material fixed to the spool 305 that slows or stops rotation of the spool 305.

An example of the bobbin 110 includes a switch 425 configured to actuate when a distance, D3, between the first pulley assembly 310 and the second pulley assembly 315 exceeds a predetermined distance. An example of the distance, D3, is 2 inches. In an example, the actuation of the switch 425 causes the brake 325 to engage. For instance, in an example, the switch 425 is positioned on the rod 320 at a predetermined distance from the second pully assembly 315, towards the spool 305. When the tension on the tow 115 decreases of releases (e.g., if the tow 115 snaps), the resilient member 420 causes the second pully assembly 315 to slide down the rod 320 and trigger the switch 425. Triggering of the switch 425 then causes the brake 325 to actuate.

In an example, a second switch 430 is provided and is configured to actuate when the distance, D3, between the first pulley assembly 310 and the second pulley assembly 315 is lower than a predetermined distance. In an example, actuation of the second switch 430 causes the brake 325 to disengage. In an example, the states of the first switch 425 and the second switch 430 control activation and deactivation of the brake 325 to maintain the tension of the tow 115 within a predetermined range.

Figure 4D:
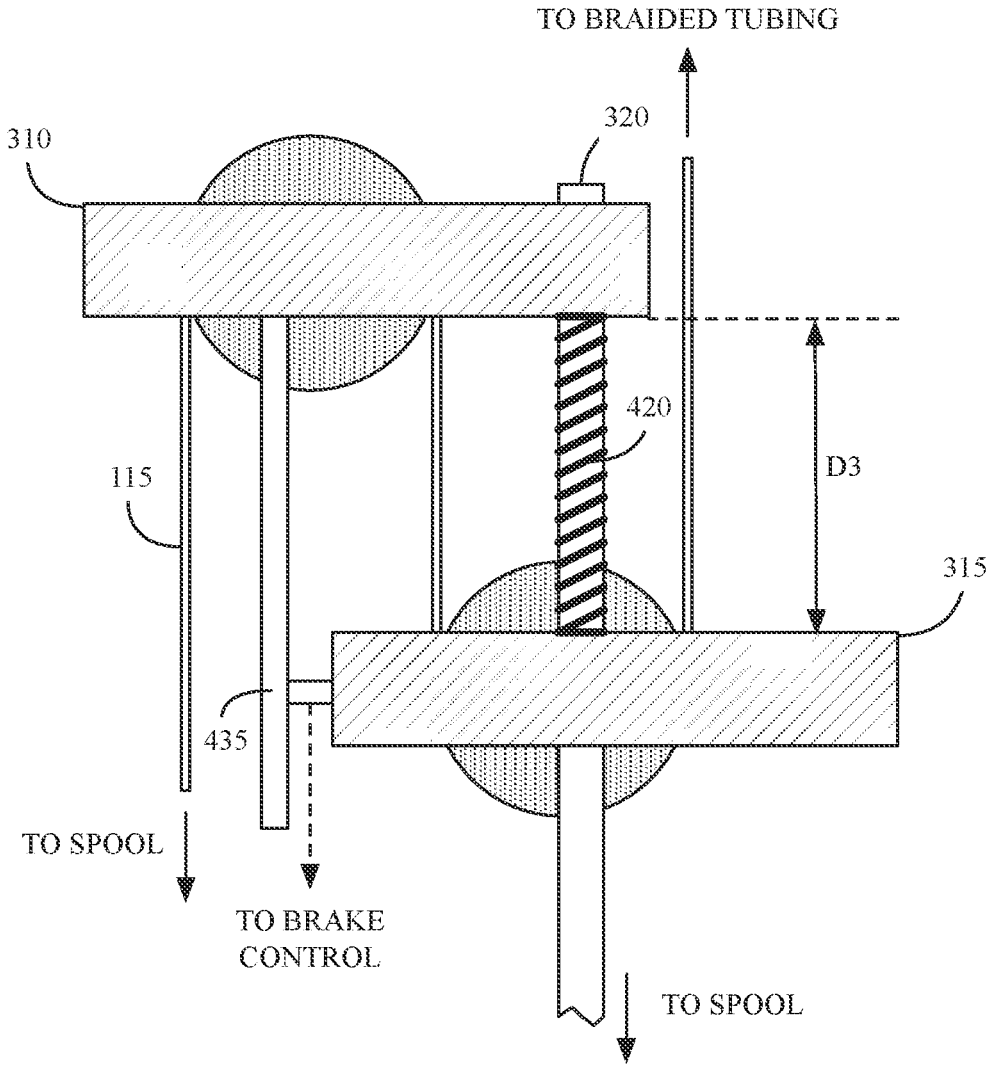
FIG. 4D illustrates the first pulley assembly and the second pulley assembly coupled to a rod of the bobbin, in accordance with an example.

As shown in FIG. 4D, in another example, the bobbin 110 includes a linear position sensor 435 that senses a position of the second pulley assembly 315 along the rod 320. In this example, the amount of braking force applied by the brake 325 depends on the position of the second pulley assembly 315. For instance, in an example, the braking force increases as the distance between the first pulley assembly 310 and the second pulley assembly 315 increases. The increase in braking force increases the tension on the tow 115. The increase in tension, in turn, acts to restrict further movement of the second pulley assembly 315 away from the first pulley assembly 310. On the other hand, the braking force decreases as the distance between the first pulley assembly 310 and the second pulley assembly 315 decreases. The decrease in the braking force decreases the tension on the tow 115.

Figure 5:
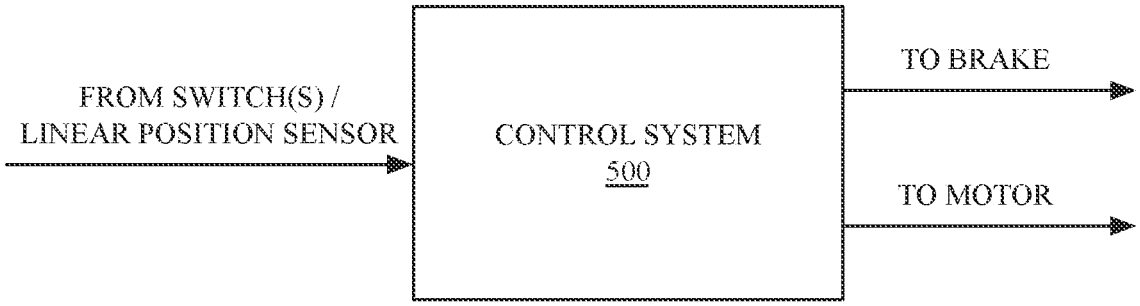
FIG. 5 illustrates a control system for controlling braking operations of the bobbin, in accordance with an example.

FIG. 5 illustrates an example of a control system 500 for controlling the braking operations noted above. In some examples, the state of the switch(s) (425, 430) and/or linear position sensor 435 described above is communicated to the control system 500. An example of the control system 500 includes one or more inputs for receiving signals associated with the switch(s) (425, 430) and/or linear position sensor 435 associated with each bobbin 110, and one or more outputs configured to communicate signals to each bobbin 110 to control the braking force applied by the brakes 325. In an example, the control system 500 controls the motor 125 that moves the bobbins 110 around the braiding wheel 105. For instance, in an example, the control system 500 controls the motor 125 to stop or slow movement of the bobbins 110 when a particular state of a bobbin 110 changes. For example, the control system 500 stops the motor 125 when the switch(s) (425, 430) and/or linear position sensor 435 change to a state indicative of a tow 115 breaking or becoming jammed. In some examples, the control system 500 includes or is in communication with a terminal that allows an operator to determine a particular bobbin 110 for which an issue is detected.

Figure 6:
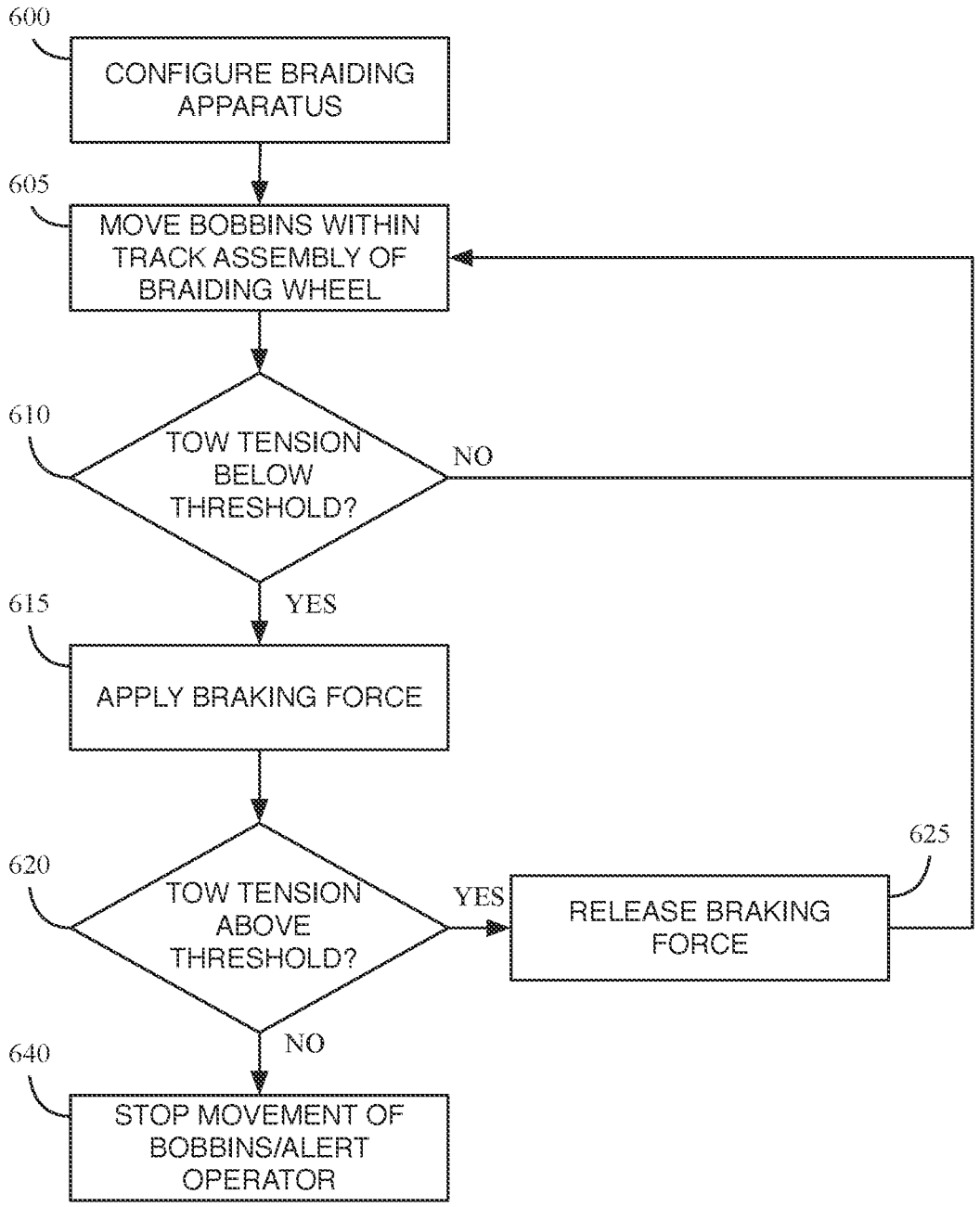
FIG. 6 illustrates operations performed by a braiding apparatus, in accordance with an example.

FIG. 6 illustrates examples of operations performed by a braiding apparatus 100. One or more of the operations are performed by a control system 500 in communication with the braiding apparatus 100. In this regard, an example of the control system 500 includes a memory that stores instruction code that causes the control system 500 to perform and/or assistance in the performance of these operations.

At block 600, the braiding apparatus 100 is configured. For instance, a plurality of bobbins 110 are arranged circumferentially around a braiding wheel 105 of a braiding apparatus 100. An example of the braiding wheel 105 includes a track assembly arranged around the periphery that facilitates moving the bobbins 110 in an interleaving manner.

A braiding material/tow 115 is wound around a spool 305 of the bobbin 110. An example of the tow 115 is formed from a prepreg thermoplastic tape and has a width, W, of ½ inch or greater and a thickness, T, of about 0.005 inches. The tow 115 is routed through a first pulley assembly 310 of each bobbin 110, through a corresponding second pulley assembly 315 of each bobbin 110, and then to a center region of the braiding apparatus 100.

At block 605, bobbins 110 are moved within the track assembly of the braiding wheel 105 of the braiding apparatus 100 to begin forming braided tubing. As noted above, an example of the braiding wheel 105 is mechanically coupled to a motor 125 configured to move the bobbins 110 within the track assembly of the braiding wheel 105. Moving of the bobbins 110, and therefore, forming of the braided tubing 120, involves activating the motor 125. In an example, the control system 500 is in communication with the motor and controls the motor to move the bobbins 110 within the track assembly.

At block 610, if the tension on a particular tow 115 is below a threshold, then at block 615 a braking force is applied to the bobbin 110 associated with that tow 115. As noted above, an example of the bobbin 110 includes a resilient member 420 arranged on a rod 320 of the bobbin 110. An example of the resilient member 420 is arranged between the first pulley assembly 310 and the second pulley assembly 315 and facilitates controlling an amount of tension on the tow 115 by allowing the second pulley assembly 315 to move along the rod 320 to increase or decrease the amount of slack/tension on the tow 115. When the distance, D3, between the first pulley assembly 310 and the second pulley assembly 315 exceeds a threshold amount, the braking force is applied. For instance, the second pulley assembly 315 actuates a switch 425 when the second pulley assembly 315 moves by more than the threshold amount.

As noted above, an example of the bobbin 110 includes a brake 325 that applies the braking force responsive to actuation of the switch 425. An example of the brake 325 is coupled to the spool 305. An example of the brake 325 is configured to apply a force against the spool 305 that slows or stops rotation of the spool 305. An example of the brake 325 slows or stops the spool 305 via magnetic induction. For instance, in an example, the brake 325 includes electromagnetic coils that, when energized, induce an electromotive force against a ferrous material fixed to the spool 305 that slows or stops rotation of the spool 305.

At block 620, if the tow tension changes to being above a threshold, then at block 625 the braking force is released. As noted above, in some examples, a second switch 430 is provided and is configured to actuate when the distance, D3, between the first pulley assembly 310 and the second pulley assembly 315 is lower than a predetermined distance. In an example, the state of the first switch 425 and the second switch 430 are used to control activation and deactivation of the brake 325 to maintain the tension of the tow 115 within a predetermined range.

If at block 620, the tow tension is not above the threshold, then at block 640, the move movement of the bobbins 110 within the track assembly of the braiding wheel 105 is stopped and an operator is alerted. In an example, the tow tension being below the threshold after having applied the braking force above can indicate that a tow 115 has broken.

As noted above, in some examples, a linear position sensor 435 is utilized to determine the distance, D3, between the first pulley assembly 310 and the second pulley assembly 315. An example of the control system 500 controls the amount of braking force applied to the spool 305 responsive to the distance. For example, the control system 500 lowers the braking force when the distance between the first pulley assembly 310 and the second pulley assembly 315 decreases, and the control system 500 increases the braking force when the distance between the first pulley assembly 310 and the second pulley assembly 315 increases. In an example, the amount of braking force applied is proportional to the distance between the first pulley assembly 310 and the second pulley assembly 315 and the tension on the tow 115 is maintained via closed-loop control.

Figure 7:
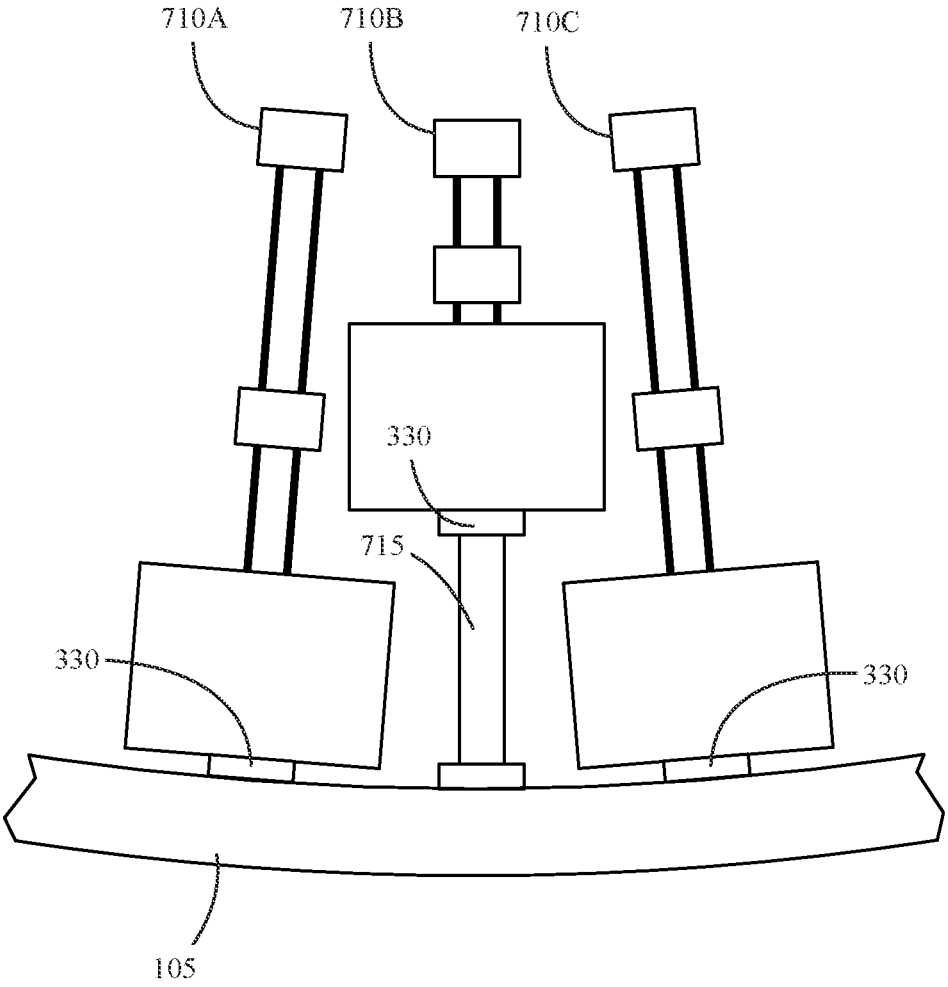
FIG. 7 illustrates bobbins arranged around a braiding wheel, in accordance with an example.

FIG. 7 illustrates examples of bobbins (710A, 710B, 710C) arranged around a braiding wheel 105. In this example, an elongated member 715 is utilized to couple a middle bobbin 710B within the track assembly of the braiding wheel 105. An example of the elongated member 715 has a length configured to position the spool 305 of the middle bobbin 710B closer to the center of the braiding wheel 105 so that the spool 305 of the middle bobbin 710B does not interfere with the spools 305 of the adjacent bobbins (710A, 710C). For instance, an example of the elongated member has a length in a longitudinal direction of about 12 inches.

An example of the elongated member 715 is a tubular structure formed from a rigid material such as a form of steel. An example of the elongated member 715 is releasably attached to the mount 330 of the middle bobbin 710B. For instance, an example of the elongated member 715 has a first end configured to be fixed to the mount 330 of a middle bobbin 710B via bolts or different types of fasteners. A second end of the elongated member 715 is configured to be coupled within the track assembly of the braiding wheel 105.

Figure 8:
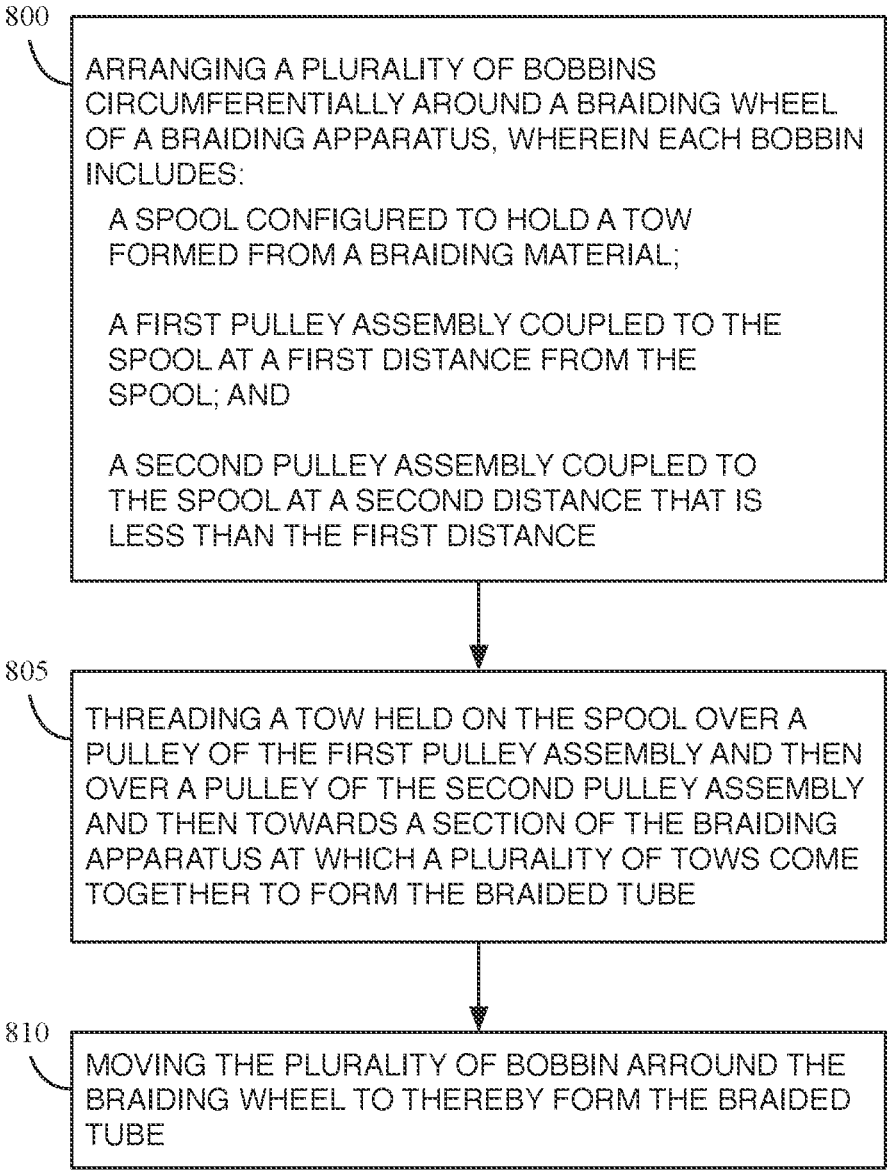
FIG. 8 illustrates a method of manufacturing braided tubing, in accordance with an example.

FIG. 8 illustrates a method of manufacturing braided tubing 120. Block 800 involves arranging a plurality of bobbins 110 circumferentially around a braiding wheel 105 of a braiding apparatus 100. Each bobbin 110 includes a spool 305 configured to hold a tow 115 formed from a braiding material, a first pulley assembly 310 coupled to the spool 305 at a first distance from the spool 305, and a second pulley assembly 315 coupled to the spool 305 at a second distance that is less than the first distance.

Block 805 involves threading a tow 115 held on the spool 305 over a pulley of the first pulley assembly 310, then over a pulley of the second pulley assembly 315, and then towards a section of the braiding apparatus 100 at which a plurality of tows 115 come together to form the braided tubing 120.

Block 810 involves moving the braiding wheel 105 to thereby form the braided tubing 120.

In some examples, arranging the plurality of bobbins 110 circumferentially around the braiding wheel 105 that each comprise a spool 305 for holding a tow 115 formed from a braiding material involves arranging a plurality of bobbins 110 circumferentially around a braiding wheel 105 that each comprise a spool 305 for holding a tow 115 formed from a prepreg thermoplastic tape having a width greater than or equal to ½ inch, and a diameter of the braided tubing 120 is greater than or equal to ten inches.

In some examples, moving the plurality of bobbins around the braiding wheel 105 to thereby form the braided tubing 120 involves moving the plurality of bobbins around the braiding wheel 105 to thereby form braided tubing 120 having a diameter greater than or equal to 10 inches.

In some examples, each bobbin 110 further comprises at least one rod 320 coupled at a first end to the spool 305. These examples involve coupling the rod 320 to the first pulley assembly 310 and the second pulley assembly 315 to the spool 305.

Some examples involve fixing the first pulley assembly 310 to a second end of the rod 320 and slidably coupling the second pulley assembly 315 to the rod 320.

Some examples involve arranging a resilient member 420 on the rod 320 and between the first pulley assembly 310 and the second pulley assembly 315 to control an amount of tension on the tow 115.

Some examples involve coupling a brake 325 to the spool 305. In these examples, when engaged, the brake 325 prevents the spool 305 from turning.

Some examples involve providing the bobbin 110 with a switch configured to actuate when a distance between the first pulley assembly 310 and the second pulley assembly 315 exceeds a predetermined amount. In these examples, the actuation of the switch causes the brake 325 to engage.

Some examples involve coupling a mount between the bobbin 110 and the braiding wheel 105.

Some examples involve coupling, on every other bobbin 110 arranged circumferentially around the braiding wheel 105, an elongated member between the spool 305 and the mount. The elongated member facilitates decreasing the spacing between adjacent bobbins 110.

Figure 9:
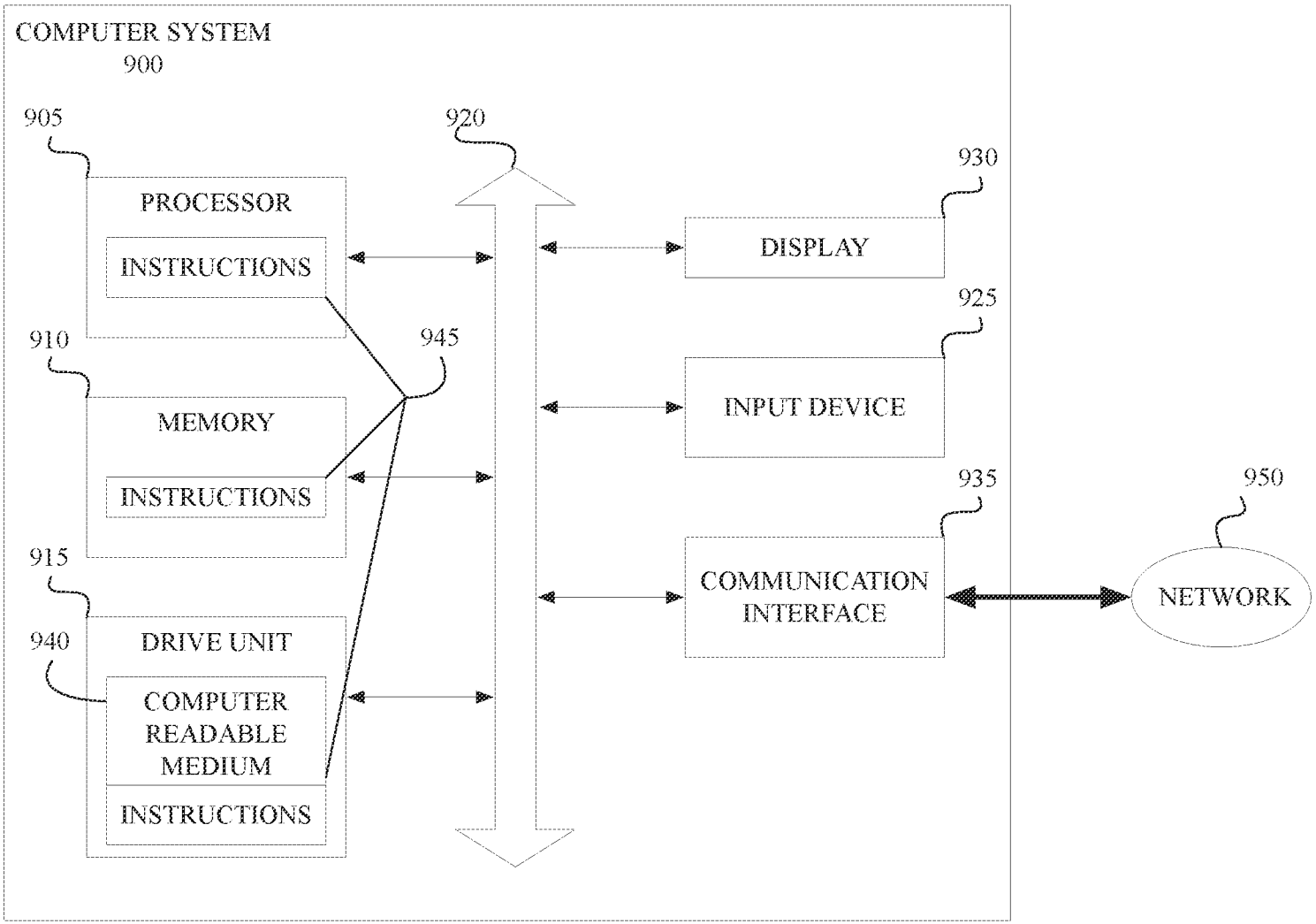
FIG. 9 illustrates a computer system that can form part of or implement any of the systems or devices disclosed herein, in accordance with an example.

FIG. 9 illustrates an example of a computer system 900 that can form part of or implement any of the systems and/or devices described above. The computer system 900 can include a set of instructions 945 that the processor 905 can execute to cause the computer system 900 to perform any of the operations described above. An example of the computer system 900 can operate as a stand-alone device or can be connected, e.g., using a network, to other computer systems or peripheral devices.

In a networked example, the computer system 900 can operate in the capacity of a server or as a client computer in a server-client network environment, or as a peer computer system in a peer-to-peer (or distributed) environment. The computer system 900 can also be implemented as or incorporated into various devices, such as a personal computer or a mobile device, capable of executing instructions 945 (sequential or otherwise), causing a device to perform one or more actions. Further, each of the systems described can include a collection of subsystems that individually or jointly execute a set, or multiple sets, of instructions to perform one or more computer operations.

The computer system 900 can include one or more memory devices 910 communicatively coupled to a bus 920 for communicating information. In addition, code operable to cause the computer system to perform operations described above can be stored in the memory 910. The memory 910 can be random-access memory, read-only memory, programmable memory, hard disk drive, or any other type of memory or storage device.

The computer system 900 can include a display 930, such as a liquid crystal display (LCD), a cathode ray tube (CRT), or any other display suitable for conveying information. The display 930 can act as an interface for the user to see processing results produced by processor 905.

Additionally, the computer system 900 can include an input device 925, such as a keyboard or mouse or touch-screen, configured to allow a user to interact with components of system 900.

The computer system 900 can also include a disk or optical drive unit 915. The drive unit 915 can include a computer-readable medium 940 in which the instructions 945 can be stored. The instructions 945 can reside completely, or at least partially, within the memory 910 and/or within the processor 905 during execution by the computer system 900. The memory 910 and the processor 905 also can include computer-readable media as discussed above.

The computer system 900 can include a communication interface 935 to support communications via a network 950. The network 950 can include wired networks, wireless networks, or combinations thereof. The communication interface 935 can enable communications via any number of wireless broadband communication standards, such as the Institute of Electrical and Electronics Engineering (IEEE) standards 802.11, 802.12, 802.16 (WiMAX), 802.20, cellular telephone standards, or other communication standards.

Accordingly, methods and systems described herein can be realized in hardware, software, or a combination of hardware and software. The methods and systems can be realized in a centralized fashion in at least one computer system or in a distributed fashion where different elements are spread across interconnected computer systems. Any kind of computer system or other apparatus adapted for carrying out the methods described herein can be employed.

The methods and systems described herein can also be embedded in a computer program product, which includes all the features enabling the implementation of the operations described herein and which, when loaded in a computer system, can carry out these operations. Computer program, as used herein refers to an expression, in a machine-executable language, code or notation, of a set of machine-executable instructions intended to cause a device to perform a particular function, either directly or after one or more of a) conversion of a first language, code, or notation to another language, code, or notation; and b) reproduction of a first language, code, or notation.

While the systems and methods of operation have been described with reference to certain examples, it will be understood by those skilled in the art that various changes can be made and equivalents can be substituted without departing from the scope of the claims. Therefore, it is intended that the present methods and systems not be limited to the particular examples disclosed, but that the disclosed methods and systems include all embodiments falling within the scope of the appended claims.

The invention claimed is:

1. A braiding apparatus for forming braided tubing, the braiding apparatus comprising:

a braiding wheel; and a plurality of bobbins configured to move circumferentially around the braiding wheel, wherein each bobbin includes:

a spool configured to hold a tow formed from a braiding material;

a first pulley assembly coupled to the spool at a first distance from the spool, wherein the first pulley assembly is configured to facilitate passing the tow over a pulley of the first pulley assembly;

a second pulley assembly coupled to the spool at a second distance that is less than the first distance, wherein the second pulley assembly is configured to facilitate receiving the tow from the first pulley assembly and passing the tow over a pulley of the second pulley assembly and towards a section of the braiding apparatus at which a plurality of tows come together to form the braided tubing;

a brake that is coupled to the spool, wherein when engaged, the brake prevents the spool from turning; and a switch configured to actuate when a distance between the first pulley assembly and the second pulley assembly exceeds a predetermined amount, wherein actuation of the switch causes the brake to engage.

2. The braiding apparatus according to claim 1, wherein each bobbin further comprises:

at least one rod coupled at a first end to the spool, wherein the at least one rod couples the first pulley assembly and the second pulley assembly to the spool.

3. The braiding apparatus according to claim 2, wherein the first pulley assembly is fixed at a second end of the rod and wherein the second pulley assembly is slidably coupled to the rod.

4. The braiding apparatus according to claim 3, wherein each bobbin further comprises a resilient member arranged on the rod and between the first pulley assembly and the second pulley assembly, wherein the resilient member facilitates controlling an amount of tension on the tow.

5. The braiding apparatus according to claim 1, wherein each bobbin further comprises a mount configured to couple the bobbin to the braiding wheel, wherein every other bobbin arranged circumferentially around the braiding wheel further comprises an elongated member that couples the spool to the mount, wherein the elongated member facilitates decreasing a spacing between adjacent bobbins.

6. The braiding apparatus according to claim 1, wherein a width of the tow is greater than or equal to ½ inch.

7. The braiding apparatus according to claim 1, wherein a diameter of the braided tubing is greater than or equal to ten inches.

8. The braiding apparatus according to claim 1, wherein the braiding material is formed from a prepreg thermoplastic tape.

9. A bobbin for a braiding tool, the bobbin comprising:

a spool configured to hold a tow formed from a braiding material;

a first pulley assembly coupled to the spool at a first distance from the spool, wherein the first pulley assembly is configured to facilitate passing the tow over a pulley of the first pulley assembly;

a second pulley assembly coupled to the spool at a second distance that is less than the first distance, wherein the second pulley assembly is configured to facilitate receiving the tow from the first pulley assembly and passing the tow over a pulley of the second pulley assembly and towards a section of a braiding apparatus at which a plurality of tows come together to form braided tubing;

a brake coupled to the spool, wherein, when engaged, the brake prevents the spool from turning; and a switch configured to actuate when a distance between the first pulley assembly and the second pulley assembly exceeds a predetermined distance, wherein actuation of the switch causes the brake to engage.

10. The bobbin according to claim 9, further comprising:

at least one rod coupled at a first end to the spool, wherein the at least one rod couples the first pulley assembly and the second pulley assembly to the spool.

11. The bobbin according to claim 10, wherein the first pulley assembly is fixed at a second end of the rod and wherein the second pulley assembly is slidably coupled to the rod.

12. The bobbin according to claim 11, further comprising a resilient member arranged on the rod and between the first pulley assembly and the second pulley assembly, wherein the resilient member facilitates controlling an amount of tension on the tow.

13. The bobbin according to claim 9, further comprising:

a mount configured to couple the bobbin to a braiding wheel of the braiding tool and an elongated member that couples the spool to the mount, wherein the elongated member facilitates decreasing a spacing between adjacent bobbins.

14. The bobbin according to claim 9, wherein a width of the tow is greater than or equal to ½ inch.

15. The bobbin according to claim 9, wherein a diameter of the braided tubing is greater than or equal to ten inches.

16. The bobbin according to claim 9, wherein the braiding material is formed from a prepreg thermoplastic tape.

17. The bobbin according to claim 9, wherein the predetermined distance is two inches.

18. A method of manufacturing braided tubing, the method comprising:

arranging a plurality of bobbins circumferentially around a braiding wheel of a braiding apparatus, wherein each bobbin includes:

a spool configured to hold a tow formed from a braiding material;

a first pulley assembly coupled to the spool at a first distance from the spool;

a second pulley assembly coupled to the spool at a second distance that is less than the first distance;

a brake coupled to the spool, wherein, when engaged, the brake prevents the spool from turning; and a switch configured to actuate when a distance between the first pulley assembly and the second pulley assembly exceeds a predetermined distance, wherein actuation of the switch causes the brake to engage;

threading a tow held on the spool over a pulley of the first pulley assembly and then over a pulley of the second pulley assembly and then towards a section of the braiding apparatus at which a plurality of tows come together to form the braided tubing; and moving the plurality of bobbins around the braiding wheel to thereby form the braided tubing.

19. The method according to claim 18, wherein arranging the plurality of bobbins circumferentially around a braiding wheel that each comprise a spool for holding a tow formed from a braiding material comprises:

arranging a plurality of bobbins circumferentially around a braiding wheel that each comprise a spool for holding a tow formed from a prepreg thermoplastic tape having a width greater than or equal to ½ inch, and a diameter of the braided tubing is greater than or equal to ten inches.

20. The method according to claim 19, wherein moving the plurality of bobbins around the braiding wheel to thereby form the braided tubing comprises moving the plurality of bobbins around the braiding wheel to thereby form braided tubing having a diameter greater than or equal to 10 inches.

* * * * *